US006714140B2

(12) United States Patent
Eguiluz Fernandez

(10) Patent No.: US 6,714,140 B2
(45) Date of Patent: Mar. 30, 2004

(54) SIGNAL LIGHT FOR RAILROADS OR THE LIKE

(75) Inventor: Jesús María Eguiluz Fernandez, Vitoria (ES)

(73) Assignee: Celaya, Emparanza Y Galdos, S.A. (CEGASA) (ES)

( * ) Notice: Subject to any disclaimer, the term of this patent is extended or adjusted under 35 U.S.C. 154(b) by 145 days.

(21) Appl. No.: 09/767,439

(22) Filed: Jan. 23, 2001

(65) Prior Publication Data

US 2002/0097166 A1 Jul. 25, 2002

(51) Int. Cl.[7] ..... G08G 1/095

(52) U.S. Cl. ..... 340/908; 340/463; 340/636.1; 340/815.4; 340/908.1

(58) Field of Search ..... 340/636.1, 907, 340/908, 463, 321, 815.4, 815.45; 307/64, 66

(56) References Cited

U.S. PATENT DOCUMENTS

| | | | | |
|---|---|---|---|---|
| 4,654,629 A | * | 3/1987 | Bezos et al. | 340/815.45 X |
| 4,847,170 A | * | 7/1989 | Martin | 429/1 |
| 5,019,803 A | * | 5/1991 | Maram | 340/636 X |
| 6,392,563 B1 | * | 5/2002 | Paquette et al. | 340/907 |

* cited by examiner

*Primary Examiner*—Thomas Mullen
(74) *Attorney, Agent, or Firm*—Nields & Lemack

(57) ABSTRACT

Signal light having first and second identical electrical cells, each having the necessary capacity to last for a standard operating cycle. The cells are electrically connected by means of a bistable switch to an electronic control circuit in stable alternative and nonalternating fashion until they are individually depleted. The electronic control circuit has one output connected to one corresponding signal light and another two outputs connected to individual light indicators which are light emitting diodes respectively assigned to the first and second electrical cells and activated by the electronic control circuit when the latter detects a depletion of the electrical energy of same.

6 Claims, 3 Drawing Sheets

SIGNAL LIGHT FOR RAILROADS OR THE LIKE

FIELD OF THE INVENTION

This invention pertains to a signal light which has two major fields of utilization.

A first and very important field of utilization is as a train "caboose", where the light is installed in the rear part of a train to give a visual signal of itself by means of flashes of light to show that a train is moving up ahead.

Another field of utilization is highway signalling, where the light is incorporated in beacons and signs, in single or multiple form; or it is used individually, but in association or combination with other similar ones. In order to give an effective notice, it is usual to operate again with flashes of light; and on the other hand, this results in greater lifetime for the available power.

PRIOR STATE OF THE ART

With regard to the train "caboose" light, it should be pointed out that this is an essential safety element which has to operate at all times, so that the train has to halt if its signal function fails.

Therefore, the train caboose light cannot be supplied from the train's own electrical power supply or electrical generator, but instead should have an independent power supply source based on an electric cell.

An electric cell has a larger or smaller capacity, yet a finite one, and therefore a traditional problem with train "caboose" lights is to check the discharge of the electric cell in order to carry out a replacement before the light no longer works or begins to function defectively.

A known system consists in always having available a replacement cell to carry out the replacement when an indicator for this purpose denotes that the cell being used has a low charge.

This system is hardly operative for a safety element as important as the one in question, since it leaves no response safety margin, and it cannot be predicted when the moment of replacement will occur, which may be halfway in the middle of a trip; furthermore, it requires constant attendance by individual persons who will take turns in this duty, so that any mix-up may result in a serious safety problem, in addition to the logistical problem of always having available a spare electric cell to replace the one merely used up in the "caboose" light.

Another known and more sophisticated system consists in using a high-capacity (several months operating life) main alkaline battery and a secondary or auxiliary battery as an emergency spare with a much lower capacity (a few hours of operation); these main and secondary batteries are in a buffer layout and have an associated electronic monitoring, so that when the main battery is used up it automatically places the secondary battery in service and activates a light indicator which shows the need to replace the main battery and gives a warning that the operating life of the secondary battery is available to accomplish this. In this system, the replacement of the main battery also implies the replacement of the secondary battery in order to have a new operating cycle available with the original emergency reserve capacity intact for this secondary battery.

This system enables a greater response capacity than the preceding one, but is still far from desirable and continues to pose not insignificant logistical problems.

In regard to the second major field of utilization, that of highway signalling, it should be pointed out that there presently exist signal lights which, like those devoted to signalling of road work or obstacles to traffic, are powered by electrical cells, since this is the most suitable for units which are needed at any given moment and in locations where there is usually no outlet connected to the power supply network, and which need to be continuously transported from a stockpile to the place of utilization, or from one place of utilization to another.

The importance of these signs being permanently in perfect condition of use is critical to traffic safety.

Nevertheless, the means used at present have a tendency to malfunction, and this even though requiring especially careful attention on the part of the workers, or perhaps precisely because they require such attention.

At present, the signal lights in question are outfitted with a single cell or with various cells connected in series or in parallel which, by their very nature, have an imprecise duration, due to their great dependency on many intrinsic and environmental factors.

In such circumstances, in order to guarantee the perfect and permanent functioning of the signal lights in their installation, one must make sure that the cell or cells are fully charged at the start of use and that there is an individual checking of the installed cells so as to replace them before they are used up.

This checking is greatly dependent upon human resources which, in addition, have scant and uncertain response time, and are subject to constant shift changes, that is, changing of the specific persons entrusted with this; therefore, there is a considerable risk of failure of monitoring. On the other hand, the level of safety which demands a proper performance of this monitoring results in replacement of the cells with a medium level of discharge, which entails a wasting of energy, and translates into an oversized park of cells and a continual replacement of them before they reach an optimal level of discharge. This results in a substantial increase in the maintenance cost. On the other hand, this monitoring also involves a considerable cost of maintenance labor, due to the frequency of replacements and the need to dispatch people on purpose for this job.

EXPLANATION OF THE INVENTION AND ITS ADVANTAGES

Given this state of affairs, this invention proposes a new and special design of signal light, which consists of two electrical cells, a first and a second one, both identical to each other and each one having the necessary capacity to last for a standard operating cycle, which by means of a bistable switch are electrically connected to an electronic control circuit in stable alternative and nonalternating fashion until they are individually depleted, which electronic control circuit has one output connected to one corresponding signal light and another two outputs connected to individual light indicators, a first and a second one, which are light emitting diodes (LED), respectively assigned to said first and second electrical cells and activated by said electronic control circuit when the latter detects a depletion of the electrical energy of same.

The operation of this new signal light is as follows: when one of the electrical cells, for example the first one, is depleted, the electronic control circuit then causes the bistable switch to connect to the other electrical cell, for example the second one, while at the same time activating the LED diode corresponding to the depleted cell, in this case, the first one; we now have at our disposal another complete standard operating cycle in the second electrical cell in order to carry out the replacement of the first, now depleted electrical cell; since we have a bistable switch, that is, one which is stable in its two alternative connection positions (to the first electrical cell or to the second electrical cell), during the time that the first depleted cell is replaced by disconnecting it and connecting a new one said bistable switch remains in its position of connection to the second cell until the latter is depleted; at this moment, the original second cell is acting as the previous first cell and when it is used up the reverse of the foregoing process will occur, that is, the bistable switch will change to its position of connection to the now second and previously first cell, while at the same time activating the second LED diode to indicate that the now first and previously second cell has to be replaced.

Given the fact that each of the two cells is capable in themselves of furnishing a duty of several months (standard operating cycle), the application of this recommended light as a train "caboose" provides very considerable advantages, namely: availability of an emergency standby period as long as a standard operating period, which redounds to much greater safety and substantially simplifies the logistics, due to the large time margin available for making the replacement of the depleted cell and the ability to do so at the most convenient time and place; much greater operating reliability of the train "caboose" signal light, due to having a redundant independent power supply system through two equal and independent electrical cells. In fact, since the train "caboose" signal light is a basic safety element not only for a particular train, but also for railway traffic as a whole, it turns out that said railway traffic will benefit from the great reliability and safety provided by this new "caboose" signal light.

As a subsidiary matter, one should also point out the economic utility from the fact that, with this new system, the electrical cells are used until effectively fully depleted.

These advantageous qualities of the proposed signal light can be utilized for a new system of independent power supply, applicable in particular to highway light signalling signs, such as flashlights, flashing beacons, beacon poles and danger triangles. For this purpose, in this new system the assemblage of said first and second electrical cells, said bistable switch, said electronic control circuit, said signal light and said first and second light indicators constitutes an independent electrical power supply unit in which said signal light is installed in a system comprised of highway signalling elements such as beacon poles, danger triangles, or compact flashing beacon units basically consisting of the light source proper and a box or body in which said independent electrical power supply unit is incorporated.

According to the invention, said independent electrical power supply unit alternatively possesses: certain synchronization transmitters/receivers in a cascade with other independent electrical power supply units which have another corresponding light source associated with them; or certain long-wave synchronization radio receivers in a cascade with other independent electrical power supply units which have another corresponding light source associated with them.

Also as an alternative, said sources will be outfitted with said signal light consisting of: a xenon bulb, an incandescent bulb, or a light emitting diode (LED) type source.

Also according to the invention, said independent electrical power supply unit is incorporated in a base or in the actual vertical body of said beacon pole, in a supporting base or in a compartment of said danger triangles, or in said box or body of said flashing beacons.

In this field of application of highway signalling, the advantageous qualities of the recommended light consist in that the use of two identical cells provides a larger time margin for the replacement of the depleted cell or cells, which considerably increases the security that the signal lights will not be without electric power, that is, it improves the safety of the traffic on the highway; furthermore, it allows the replacements to occur in the vast majority of occasions at the material stockpile, which entails a considerable savings of labor maintenance cost and dispatching of personnel, and results in better planning and utilization of the necessary and available human resources; on the other hand, there is better utilization of the cells and their replacement always occurs at an optimal level of discharge, which means that they have a longer lifetime and the size of the battery park will even be reduced, since it is not necessary to work with a safety margin as great as heretofore.

On the other hand, this new system has the virtue of combining these advantages with the use of the most modern technology which enables a cascading synchronization of several signal lights for mutual interaction or interaction with regard to a common independent external transmitter which operates as a time standard (long wave radio reception).

DRAWINGS AND REFERENCES

In order to better comprehend the nature of the present invention, the enclosed drawings show a preferable industrial embodiment, which is a merely illustrative and not limiting example.

These figures have the following references:

1—First electrical cell

2—Second electrical cell

3—Bistable switch

4—Electronic control circuit

5—Signalling light

6—First LED diode

7—Second LED diode

9—Independent electric power supply unit

10—Source

11—Beacon pole

12—Danger triangle

13—Flashing beacon

14—Box or body of the flashing beacon

15—Base of the beacon pole (11)

16—Signal cone

17—Signal pyramid tripod

EXPLANATION OF A PREFERRED EMBODIMENT

With regard to the above-enumerated drawings and references, the enclosed diagrams illustrate a preferred embodiment of the recommended signal light.

Figure 2:
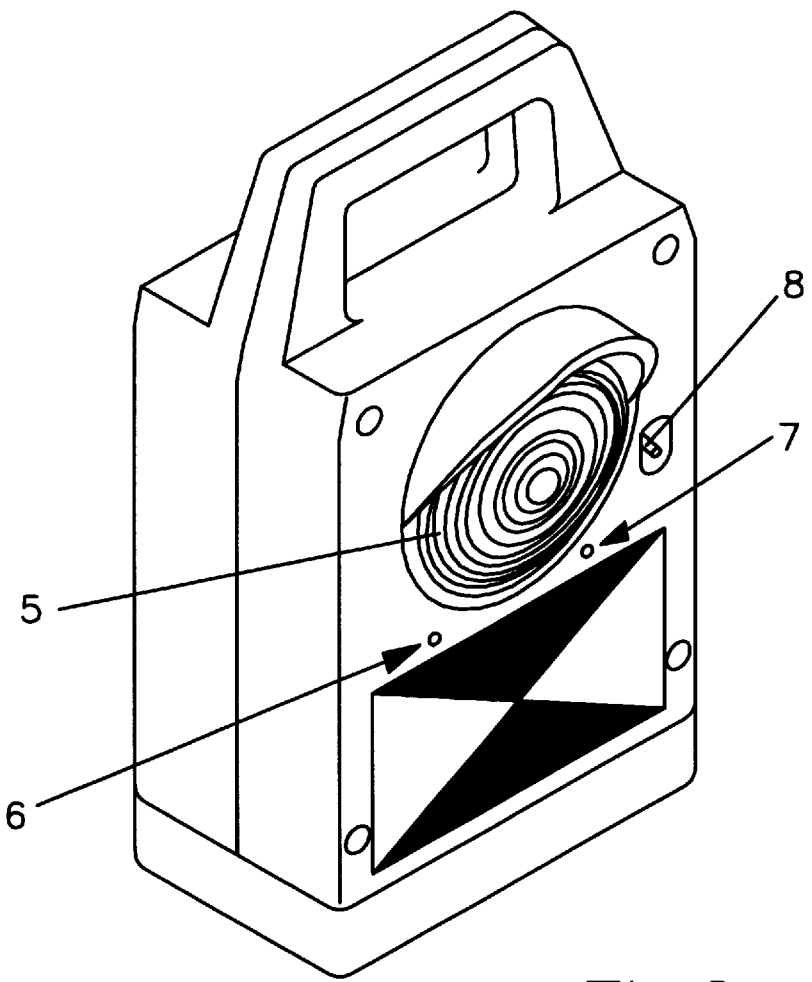
FIG. 2 is a perspective view showing the exterior of a "caboose" signal light according to the invention.
Figure 1:
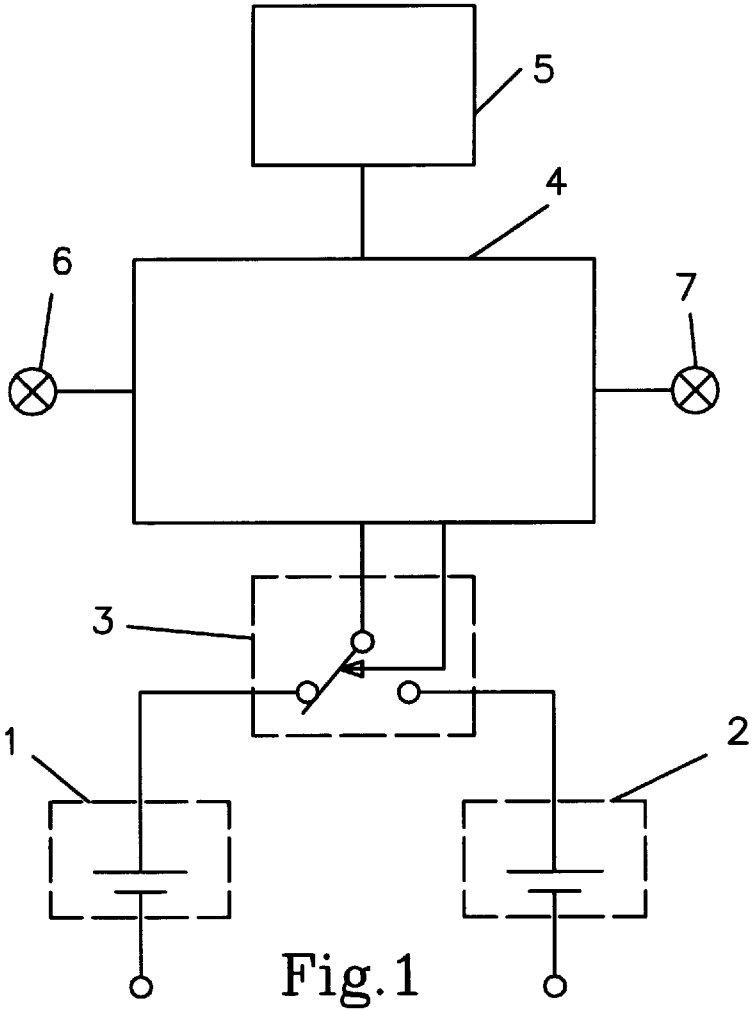
FIG. 1 is a block diagram schematically illustrating the makeup of the new "train caboose" signal light, not showing the general operating switch of said light.

FIGS. 1 and 2 make particular reference to its application as a train "caboose", intended to offer a visual indication of the end of a train traveling up ahead and it is a fundamental safety element of railway traffic. FIGS. 3 through 9 make particular reference to its application in the field of highway signalling.

In both modes of application, the signal light consists of two electrical cells, first (1) and second (2), identical to each other and with individual capacity needed to provide service for a standard operating cycle, which by means of a bistable switch (3) are electrically connected to an electronic control circuit (4) in a stable alternative and not alternating manner until they are individually depleted, whose electronic control circuit (4) has one output connected to the corresponding signal light (5) and another two outputs connected to respective light indicators, first (6) and second (7), which are light emitting diodes (LED) that are respectively assigned to said first (1) and second (2) electrical cells and that are activated by said electronic control circuit (4) when the latter detects a depletion of the electrical energy of same.

This new device is illustrated schematically by means of FIG. 1, where the bistable switch (3) has the first electrical cell (1) in service so that the signal light (5) continually emits flashes while the general switch (8) (not shown in this figure; see FIG. 2) is in the on position. When this first electrical cell (1) is used up, the electronic control circuit (4) will give notice thereof by making the bistable switch (3) change to the other connection position, placing in service the second electrical cell (2), while at the same time activating the first LED diode (6), indicating said situation of depletion of the first electrical cell (1). There is now available another standard operating cycle handled by the second electrical cell (2) in order to carry out the replacement of the first electrical cell (1), during which operation the second electrical cell (2) remains connected, thanks to the bistable condition of said bistable switch (3). When this second electrical cell (2) is used up, the bistable switch (3) will again place in service the first electrical cell (1) (the condition represented in FIG. 1) and a new cycle will commence, as described, of two standard operating periods.

Figure 3:
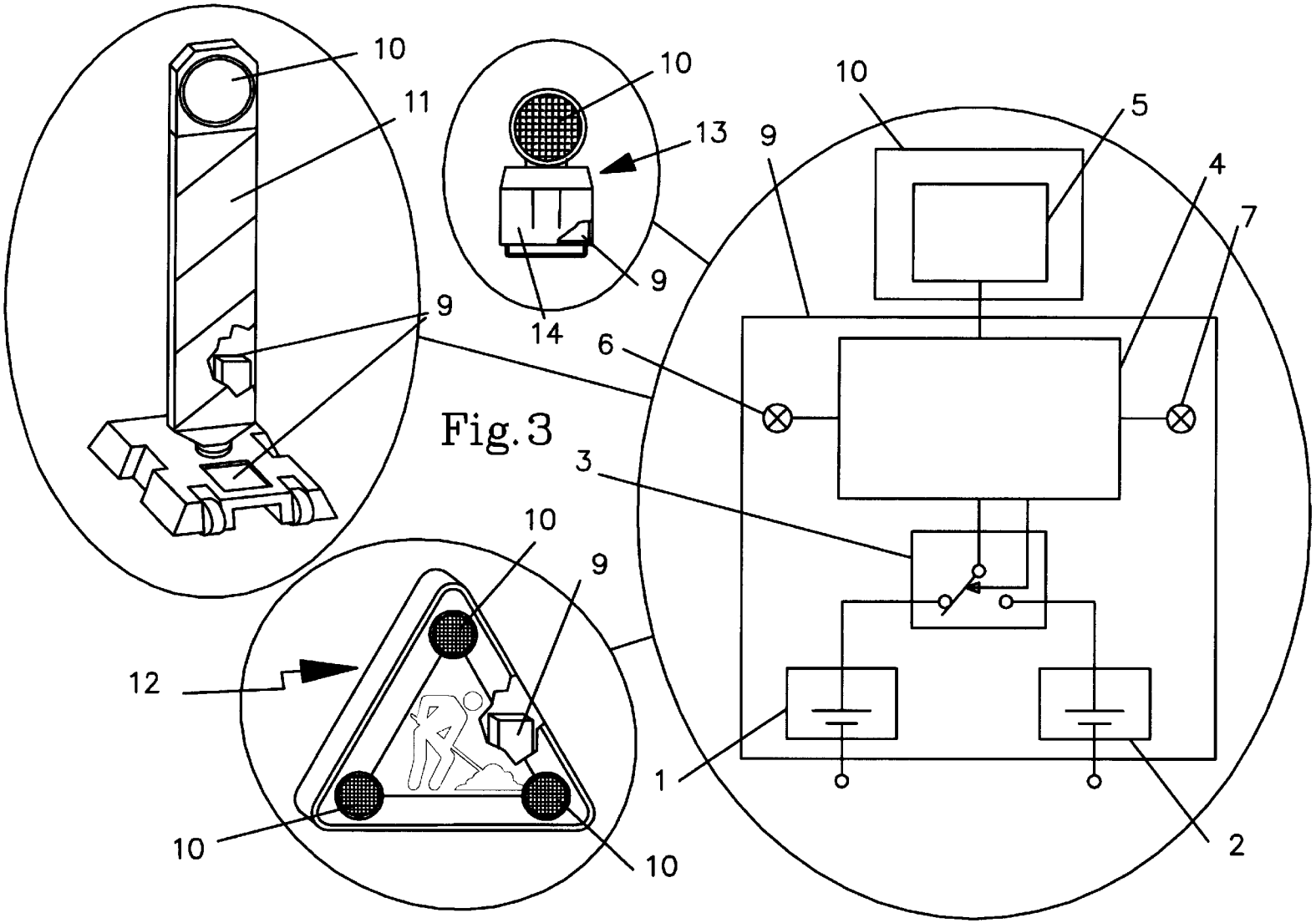
FIG. 3 shows a block diagram similar to that of FIG. 1, but adapted to highway signalling use and corresponding to the internal makeup of the light signalling elements incorporated in this FIG. 3 and involving a beacon pole (11), a danger triangle (12), and a flashing beacon (13).

In its application to highway signalling, the proposed device is schematically illustrated by means of FIG. 3, where the assemblage of said first and second electrical cells, said bistable switch (3), said electronic control circuit (4), said signal light (5) and said first (6) and second (7) light indicators constitutes an independent electrical power supply unit (9), in which said signal light (5) is installed in a source (10) which is contained in highway signalling elements such as beacon poles (11), danger triangles (12), or compact flashing beacon units (13), basically consisting of said source (10) proper and a box or body (14), in which said independent electrical power supply unit (9) is incorporated.

In accordance with the invention, each of the thus constituted independent electrical power supply units (9) can have synchronization transmitters/receivers in a cascade with other independent electrical power supply units (9) which have their own corresponding source (10). By placing each independent electrical power supply unit (9) in the field of action of another preceding one, it happens that when the first of these is connected/disconnected, the others are connected/disconnected, and in the connected condition they are automatically synchronized to function in a cascade.

As an alternative, the invention contemplates that said independent electrical power supply unit (9) has long-wave synchronization radio receivers in a cascade with other independent electrical power supply units which have a corresponding source (10). In this case, the cascade synchronization is produced in relation to the DCF 77 clock signal, produced in Germany.

In FIG. 3, the beacon pole (11) simultaneously shows two alternatives for location of the independent electrical power supply unit (9), incorporated in a base (15) and in the actual vertical body of said beacon pole (11). Likewise, this independent electrical power supply unit (9) will be located in a supporting base (not shown) of the danger triangle (12) or in a compartment, for example, inside it. In the case of the flashing beacon (13), the independent electrical power supply unit (9) is located in its body or box (14).

Figure 4:
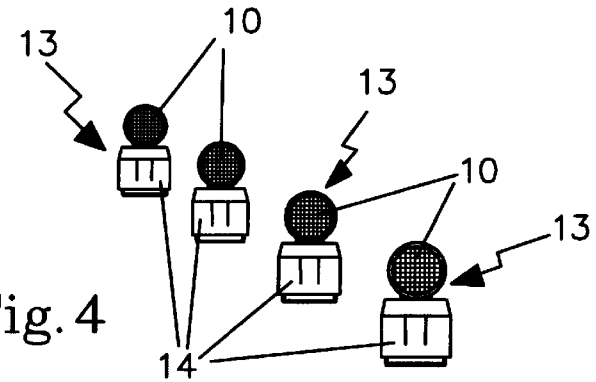
FIG. 4 shows an arrangement of flashing beacons (13) according to the invention for cascade synchronization.
Figure 5:
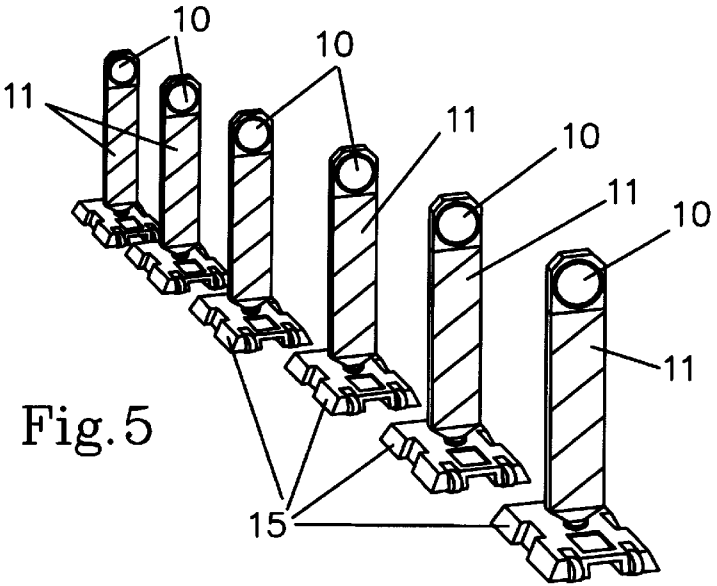
FIG. 5 is an arrangement similar to that of FIG. 4, but pertaining to beacon poles (11).
Figure 7:
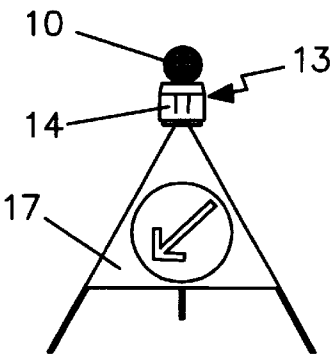
FIG. 7 is similar to FIG. 6, but pertaining to a pyramid tripod (17).
Figure 6:
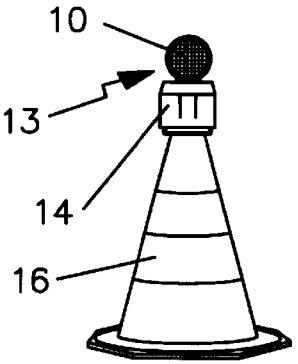
FIG. 6 shows a flashing beacon (13) according to the invention, installed on a highway signal cone (16).

The aforesaid cascade synchronization arrangements are illustrated in FIGS. 4 and 5, respectively, for flashing beacons (13) and beacon poles (11).

The compactness and portability of the portable flashlights (13) enables their use at the top of signal cones (16) or pyramid tripods (17) which, of course, can be synchronized in a cascade with other similar ones.

Figure 9:
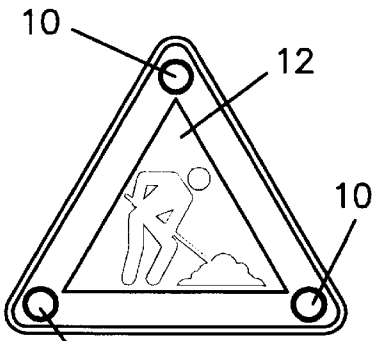
FIG. 9 shows a danger sign (12) outfitted with light emitting diode (LED) sources (10).
Figure 8:
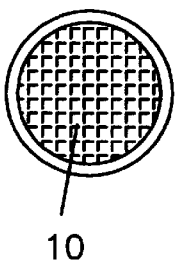
FIG. 8 shows a source (10) based on light emitting diodes (LED).

In FIGS. 3 through 7, the sources (10) are the kind outfitted with xenon bulbs, but they may be of incandescent type, made from light emitting diodes (LED), as shown by FIG. 8 and like those installed in the danger triangle (12) of FIG. 9, by contrast with that shown in FIG. 1.

What is claimed is:

1. Signal light for railroad cars to visually signal the end of trains, characterized in that it comprises two electrical cells, a first (1) and a second (2), identical to each other and with the individual capacity necessary to function during a standard operating cycle, which by means of a bistable switch (3) are electrically connected to an electronic control circuit (4) in a stable alternative and not alternating manner until they are individually used up, which electronic control circuit (4) has one output connected to a corresponding signal light (5) and another two outputs connected to respective light indicators, a first (6) and a second (7) one, which are light emitting diodes (LED) that are respectively assigned to said first (1) and second (2) electrical cells and that are activated by said electronic control circuit (4) when said electronic control circuit detects a depletion of the electrical energy of said cells.

2. Signal light for highway signal elements, characterized in that an independent electrical power supply unit comprises first and second electrical cells, a bistable switch (3), an electronic control circuit (4), and first (6) and second (7) light indicators, and wherein a signal light (5) is installed in a source (10) which is contained in said highway signal elements that are comprised of said source (10) proper and a box or body (14) in which said independent electrical power supply unit (9) is incorporated.

3. Signal light in accordance with claim 2, further characterized in that said sources (10) are outfitted with one such signal light (5), consisting of a xenon bulb.

4. Signal light in accordance with claim 2, further characterized in that said sources (10) are outfitted with one such signal light comprising light emitting diodes (LED).

5. Signal light in accordance with claim 2, further characterized in that said sources (10) are outfitted with one such signal light (5), consisting of an incandescent bulb.

6. Signal light in accordance with claim 2, wherein said highway signal elements are selected from the group consisting of beacon poles, danger triangles and compact flashing beacon units.

* * * * *